US006116163A

United States Patent [19]

Mitchell

[11] Patent Number: 6,116,163

[45] Date of Patent: Sep. 12, 2000

[54] ADJUSTABLE WORK TABLE

[76] Inventor: Robert A. Mitchell, 41 Willis Ave., Cresskill, N.J. 07626

[21] Appl. No.: 09/124,369

[22] Filed: Jul. 29, 1998

[51] Int. Cl.[7] ..... A47B 23/00

[52] U.S. Cl. ..... 108/42; 108/152; 248/244; 182/129

[58] Field of Search ..... 108/42, 47, 152; 312/330.1, 334.7; 248/295.11, 297.31, 244; 182/129

[56] References Cited

U.S. PATENT DOCUMENTS

| | | | |
|---|---|---|---|
| 994,855 | 6/1911 | Mali | 108/42 |
| 2,875,904 | 3/1959 | Gingher et al. | 248/244 X |
| 3,286,662 | 11/1966 | Connery | 248/244 X |
| 3,490,558 | 1/1970 | Foley | 182/129 |
| 4,534,447 | 8/1985 | Champigny | 182/152 |
| 4,805,735 | 2/1989 | Anderson | 182/129 X |
| 4,819,900 | 4/1989 | Funk | 248/244 |
| 4,834,217 | 5/1989 | Manes | 108/152 X |
| 5,244,272 | 9/1993 | Thompson | 312/330.1 X |
| 5,386,787 | 2/1995 | Hall | 108/42 X |
| 5,622,463 | 4/1997 | Testa | 182/129 X |
| 5,628,552 | 5/1997 | O'Barr | 312/330.1 |
| 5,775,655 | 7/1998 | Schmeets | 108/42 X |

*Primary Examiner*—Peter M. Cuomo
*Assistant Examiner*—Hanh V. Tran
*Attorney, Agent, or Firm*—Richard A Joel, Esq

[57] ABSTRACT

An adjustable work table for use with scaffolding comprises a substantially rectangular table top having a first pair of downwardly extending rails at one end which slidably mount on scaffolding. The rails are elongated generally U-shaped members which include an intermediate semicircular portion extending outwardly and having a spring loaded lock pin mounted therein to engage the scaffold through an aperture in the rail locking the table in place. A second pair of U-shaped elongated rails extend outwardly at a right angle to the first pair of rails beneath the ends of the table and a supporting member extends between the lower portion of the first pair of rails and an intermediate portion of the second pair of rails for support purposes. A drawer may be mounted at the open end beneath the table.

7 Claims, 1 Drawing Sheet

ADJUSTABLE WORK TABLE

BACKGROUND OF THE INVENTION

This invention relates to scaffolding and particularly to an adjustable work table used on scaffolding.

The prior art includes U.S. Pat. No. 4,609,071 to Edwards which discloses a collapsible scaffold. The patent includes a pair of spaced apart vertical ladder configured frames with horizontally extending members upon which a board may rest.

U.S. Pat. No. 4,534,447 to Champigny discloses a foldable scaffold including a frame and a people supporting plank. U.S. Pat. No. 4,576,251 discloses a scaffold with unique hook and holder members. Of general interest are French patent 1,135,256 and Swiss patent 395,503.

The prior art focuses on scaffolding and none of the patents discloses a work table used in conjunction with scaffolding. The present invention may be used in conjunction with the prior art but it is unique and greatly enhances the ability of workmen to function on scaffolding.

SUMMARY OF THE INVENTION

This invention discloses an adjustable work table used on scaffolding. The table may be detachably mounted on the scaffolding at various locations to facilitate the work being performed and to eliminate safety hazards which occur when a workman is forced to bend over for various reasons.

The work table includes a spaced pair of vertical rails having an elongated channel to attach to mating posts on the scaffold. A substantially rectangular table extends outwardly between the rails and is supported on each side by horizontal rails mounted underneath the edges of the table and joined at a right angle to the vertical rails. The vertical rails each include a lock pin which extends through an aperture in the rail to engage a scaffold post for locking purposes. A cross member extends between the lower portion of each vertical rail and an intermediate portion of the corresponding perpendicular rail for support purposes. A drawer may be mounted beneath the table surface.

Accordingly, an object of this invention is to provide a new and improved work table for use with scaffolding.

Another object of this invention is to provide a new and improved work table which is adjustable and readily mounts to scaffolding.

A further object of this invention is to provide a new and improved work table which is lightweight, adjustable and includes locking means for mounting to scaffolds.

A more specific object of this invention is to provide a new and improved adjustable table for use with scaffolds which includes a vertical rails which mate with scaffold posts and locking means associated with the rails to lock the table which is supported by the vertical and horizontal rails in position.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
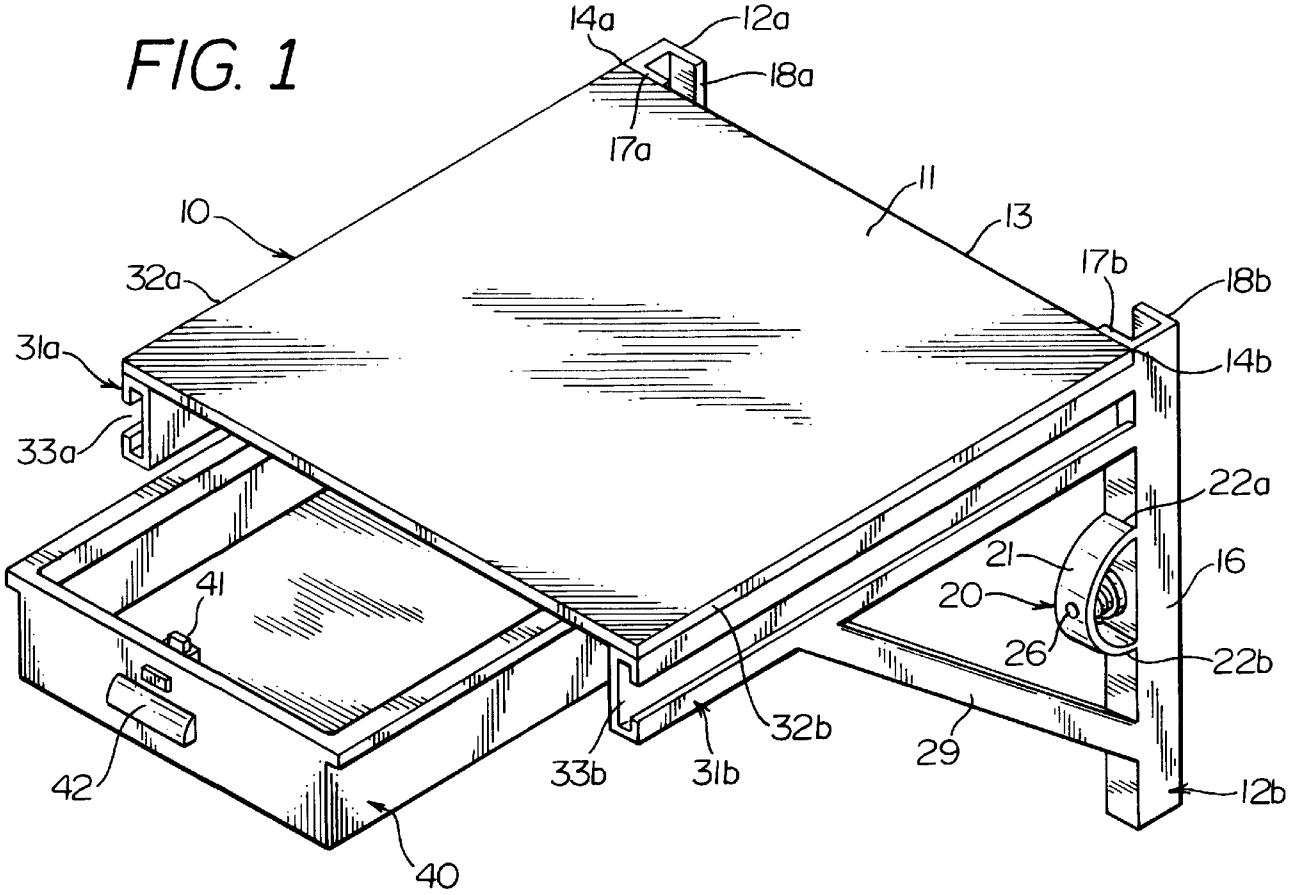
FIG. 1 is a perspective view of the invention.
Figure 2:
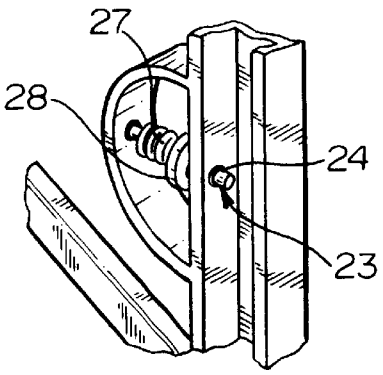
FIG. 2 is an enlarged view of the locking mechanism which secures the invention to a scaffold.

Referring now to FIG. 1 of the drawings, the invention comprises an adjustable table 10 for use with scaffolding.

The table 10 includes a planar surface 11 which is substantially rectangular in configuration and a pair of supporting rails or posts 12*a* and 12*b* which extends downwardly at the forward edge 13 of the surface 11. The rails 12*a* and 12*b* are each mounted at an end 14*a*, 14*b* of the table edge 13.

The rails 12*a* and 12*b* comprise an elongated member having substantially U-shaped cross section with the base 16*a*, 16*b* of each "U" facing one another and one leg 17*a*, 17*b* being affixed to the table edge 13 and the other leg 18*a*, 18*b* being spaced therefrom. The U-shaped or channel shaped rails 12*a* and 12*b* mount on mating posts (not shown) on scaffolding. The table 10 is readily mounted on the scaffold by merely positioning the rails 12*a* and 12*b* on scaffold posts and sliding the table 10 to a desired height. The positioning of the table 10 at a convenient height eliminates the safety hazard which occurs when an individual has to bend over on the scaffold for supplies etc. Having supplies on the table 10 also speeds up the job.

The rails 12*a* and 12*b* each include a locking mechanism 20 mounted on the legs 17*a* and 17*b*. The mechanism comprises a curved semi-circular portion 21 affixed to the leg 17*a* or 17*b* at each end 22*a* and 22*b*, and a spring loaded pin 23 which extends at one end through an aperture 24 in the leg 17*a* or 17*b* to engage the scaffolding post (not shown). The other end of the pin 23 is mounted in a recess 26 in the curved portion 21. A coiled spring 27 surrounds the pin 23 and engage the curved portion 21 at one end and a washer 28 affixed to the pin 21 at the other end. The spring loaded pins 23 engages the scaffold posts with sufficient force to lock the table 10 in place.

A cross member portion 29 extends upwardly at an angle from a lower portion of each rail 12*a* and 12*b* to an intermediate portion of each side rail 31*a* and 31*b* for support purposes. The side rails 31*a* and 31*b* are mounted beneath the side edges 32*a* and 32*b* of the table surface 11. The rails 31*a* and 31*b* are affixed at a right angle to a corresponding vertical rail 12*a* or 12*b*. In cross section, the rails 31*a* and 31*b* each include a slotted portion 33*a* and 33*b* running along the length thereof. The side rails 31*a*, 31*b*, cross members 29 and support rails 12*a*, 12*b* may comprise a single light weight unitary structure of metal or of plastic for ease of handling and shipping.

A drawer 40 may be mounted beneath the table surface 11 in a conventional manner. The drawer 40 may include a lock 41 for security purposes and a readily accessible handle 42.

In use, the rails 12*a* and 12*b* would be positioned over scaffold posts (not shown) and adjusted to the desired level. The locking pins 23 maintain pressure on the posts while the angular member also include a horizontal force component which assists in holding the table 10 in place. It is also to be noted that the vertical rails 12*a* and 12*b* may be of curved configuration to engage cylindrical posts (not shown).

While the invention has been explained by a detailed description of certain specific embodiments, it is understood that various modifications and substitutions can be made in any of them within the scope of the appended claims which are intended also to include equivalents of such embodiments.

What is claimed is:

1. An adjustable table for use with scaffolding comprising:

a table having a planar surface with a front edge, a rear edge and a pair of side edges;

a pair of elongated supporting rails each mounted at right angles to one end of the front edge of said table, said rails having a substantially U-shaped cross-section including a base and outwardly extending legs for mounting directly to scaffolding;

a pair of side rails, each mounted to one side edge of the table, and having a front end mounted to a corresponding supporting rail;

a first and a second cross member each having a front end mounted to an intermediate portion of a corresponding supporting rail and a rear end mounted to an intermediate portion of a corresponding side rail; and, means positioned on one of said legs for locking the supporting rails to the scaffolding during use and for permitting adjustment of the table in a vertical plane.

2. An adjustable table for use with scaffolding in accordance with claim 1 wherein:

the locking means comprises an integral curved semicircular portion on each supporting rail having a recess, a pin having one end mounted in the recess, a coiled spring mounted about the pin, a washer mounted about the other end of the pin and engaged by the spring and an aperture in each rail engaged by a corresponding pin to lock the table in position with the pin contacting the scaffolding.

3. An adjustable table for use with scaffolding in accordance with claim 2 wherein:

the side rails each comprise elongated channel members having a groove extending along the outer surface thereof.

4. An adjustable table for use with scaffolding in accordance with claim 2 further including:

a drawer slidably mounted beneath the planar surface of the table.

5. An adjustable table for use with scaffolding in accordance with claim 2 wherein:

the supporting rails each comprise a curved cross-section to engage the scaffolding.

6. An adjustable table for use with scaffolding in accordance with claim 2 wherein:

the supporting rail, the cross member and the side rail form a unitary structure.

7. An adjustable table for use with scaffolding in accordance with claim 2 wherein:

the legs of the substantially U-shaped members face each other and are adapted to engage the scaffolding.

* * * * *